US006213617B1

(12) United States Patent
Barker

(10) Patent No.: US 6,213,617 B1
(45) Date of Patent: Apr. 10, 2001

(54) FAN BLADE ILLUMINATION APPARATUS

(76) Inventor: Dale E. Barker, 1318 State St., Alton, IL (US) 62002

( * ) Notice: Subject to any disclaimer, the term of this patent is extended or adjusted under 35 U.S.C. 154(b) by 0 days.

(21) Appl. No.: 09/457,276

(22) Filed: Dec. 8, 1999

Related U.S. Application Data

(63) Continuation-in-part of application No. 08/936,417, filed on Sep. 25, 1997.

(51) Int. Cl.[7] ..... F21V 33/00

(52) U.S. Cl. ..... 362/96; 362/276; 362/802; 416/5

(58) Field of Search ..... 362/96, 253, 234, 362/249, 276, 802; 416/5

(56) References Cited

U.S. PATENT DOCUMENTS

| | | | | |
|---|---|---|---|---|
| 5,082,422 | | 1/1992 | Wang | 416/5 |
| 5,110,261 | * | 5/1992 | Junkin | 416/204 R |
| 5,516,264 | * | 5/1996 | Anetrini | 416/62 |
| 5,800,049 | | 9/1998 | Todd, Jr. | 362/294 |

* cited by examiner

*Primary Examiner*—Alan Cariaso
*Assistant Examiner*—Ronald E. DelGizzi
(74) *Attorney, Agent, or Firm*—Blackwell Sanders Peper Martin

(57) ABSTRACT

A fan blade illumination apparatus associated with a fan for illuminating indicia associated with at least one fan blade, the apparatus including at least one strobe light unit associated with the fan, the strobe light unit being positioned and located so as to direct light onto the at least one fan blade at a particular location during the rotation of such fan blade, an emitter associated with the fan operable to emit a signal therefrom, a sensor positioned to sense the rotational motion of the at least one fan blade based upon the signal emitted by the emitter, and a controller coupled to the sensor and to the at least one strobe light unit, the controller being operable to control the operation of the at least one strobe light unit based upon the rotational speed of the fan as determined by the controller based upon signals received from the sensor, the at least one strobe light unit being synchronized with the rotation of the at least one fan blade such that indicia associated with the fan blade will appear statically still at a particular location during the rotational motion of the fan blade.

12 Claims, 2 Drawing Sheets

FAN BLADE ILLUMINATION APPARATUS

This application is a continuation-in-part application of co-pending U.S. patent application Ser. No. 08/936,417 filed Sep. 25, 1997.

TECHNICAL FIELD

This invention relates generally to ceiling fans and means for illuminating the fan blades associated therewith and, more particularly, to a flashing strobe light arrangement which is synchronized to the rotational speed of the fan to illuminate and display designs, signage, and other indicia associated with one or more of the fan blades.

BACKGROUND OF THE INVENTION

Associating signage, designs and/or other indicia with one or more of the fan blades associated with a typical ceiling fan can result in a great marketing tool for advertising a wide variety of different types of goods and services if such indicia can be easily viewed when the fan blades are in motion. Typically, such indicia, which can be imprinted directly onto any plurality of fan blades or onto fan blade covers associated with a particular ceiling fan, is not clearly visible when the fan blades are in motion due to the rotational speed of the ceiling fan. As a result, optimum display of any such fan blade indicia is not achieved.

It is therefore desirable to have an apparatus associated with a ceiling fan to allow the indicia associated with the fan blades to be viewed statically when the fan blades are in motion regardless of the rotational speed of the fan. It is also desirable to have an apparatus associated with a ceiling fan which will allow the indicia associated with a plurality of fan blades to be observed in a flow type pattern.

Accordingly, the present invention is directed to overcoming one or more of the problems as set forth above.

SUMMARY OF THE INVENTION

According to one aspect of the present invention, one or more strobe light units are provided for synchronized operation with an operable ceiling fan having at least one rotating fan blade with indicia imprinted thereon or otherwise associated therewith, the synchronized operation of the strobe light units being based upon the rotational speed of the fan and allowing convenient static observation of the indicia associated with the fan blades. Any conventionally constructed light unit capable of pulsed illumination with a desired visual effect may be used in association with the present invention. The light units can be mounted directly onto the fan, or such light units can be mount separate from the fan so long as such light units are operable in cooperation with the operation of the fan. In this regard, the strobe light flashes are coordinated with the speed of the fan in order to illuminate a particular fan blade at a particular predetermined location while the fan is in operation in order to project a still image. Alternatively, the strobing light flashes can likewise be coordinated with the speed of the fan in order to illuminate a running flow pattern of the indicia associated with the respective fan blades. The speed of the fan may be determined by any electro-mechanical sensor usable therefor, such as an electronic eye whose light beam is interrupted by the rotational movement of the fan blades, or by a magnetic sensor capable of sensing each pass of the respective fan blades whereby the number of sensor interruptions may be counted over a specific time interval and the speed of the fan may be calculated therefrom. The strobing of the light units can therefore be coordinated with the speed of the fan to achieve the desired visual effect. Alternatively, the strobing of the lights may be triggered directly by the passing of the fan blades when sensed by the sensor as described above.

Other modifications to the present invention are also contemplated, such as multiple flashing of the fan blades in a single fan blade revolution whereby multiple static images, or multiple flow patterns, can be viewed. One skilled in the art will appreciate that numerous such modifications and improvisations are possible without departing from the sprit and scope of the present invention.

It is therefore an object of the present invention to provide one or more strobing lights which can be synchronized in cooperation with the speed of a fan in order to illuminate and project any design, signage or other indicia associated with a rotating fan blade into one or more static images, or into one or more flow patterns.

It is a further object of the present invention to provide a simple and cost effective method and apparatus to illuminate and project a visually distinguishable static image or a visually distinguishable flow pattern based upon indicia associated with one or more rotating fan blades.

These and other objects and advantages of the present invention will become apparent to those skilled in the art after considering the following detailed specification of the present invention in conjunction with the accompanying drawings.

BRIEF DESCRIPTION OF THE DRAWINGS

For a better understanding of the present invention, reference may be made to the accompanying drawings in which.

DETAILED DESCRIPTION OF THE INVENTION

Figure 1:
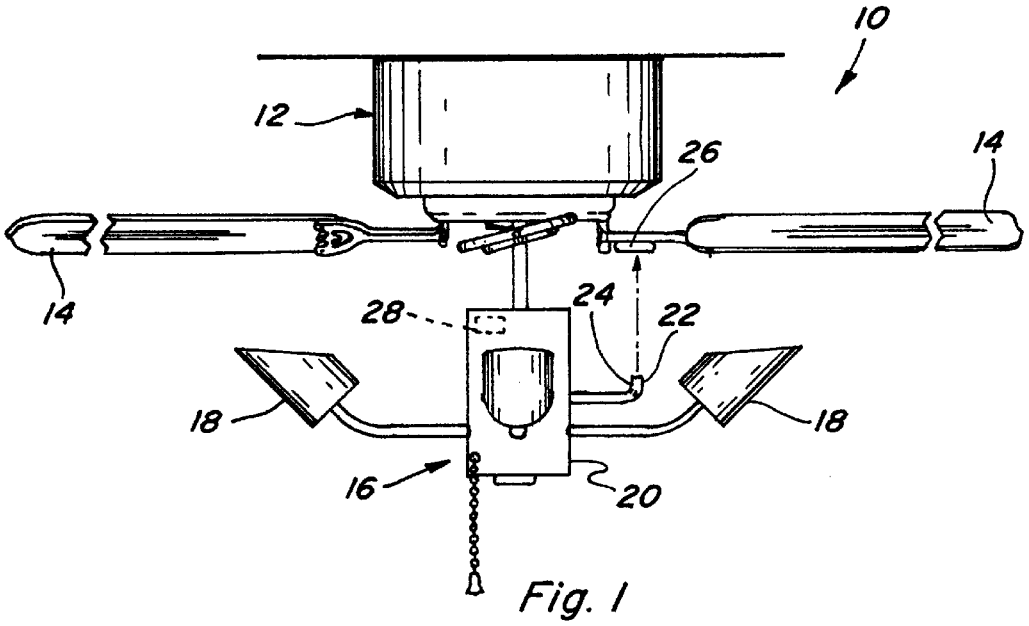
FIG. 1 is a side elevational view of a ceiling fan having lights and an emitter sensor associated therewith for illuminating indicia imprinted on the fan blades constructed in accordance with the teachings of one embodiment of the present invention.
Figure 2:
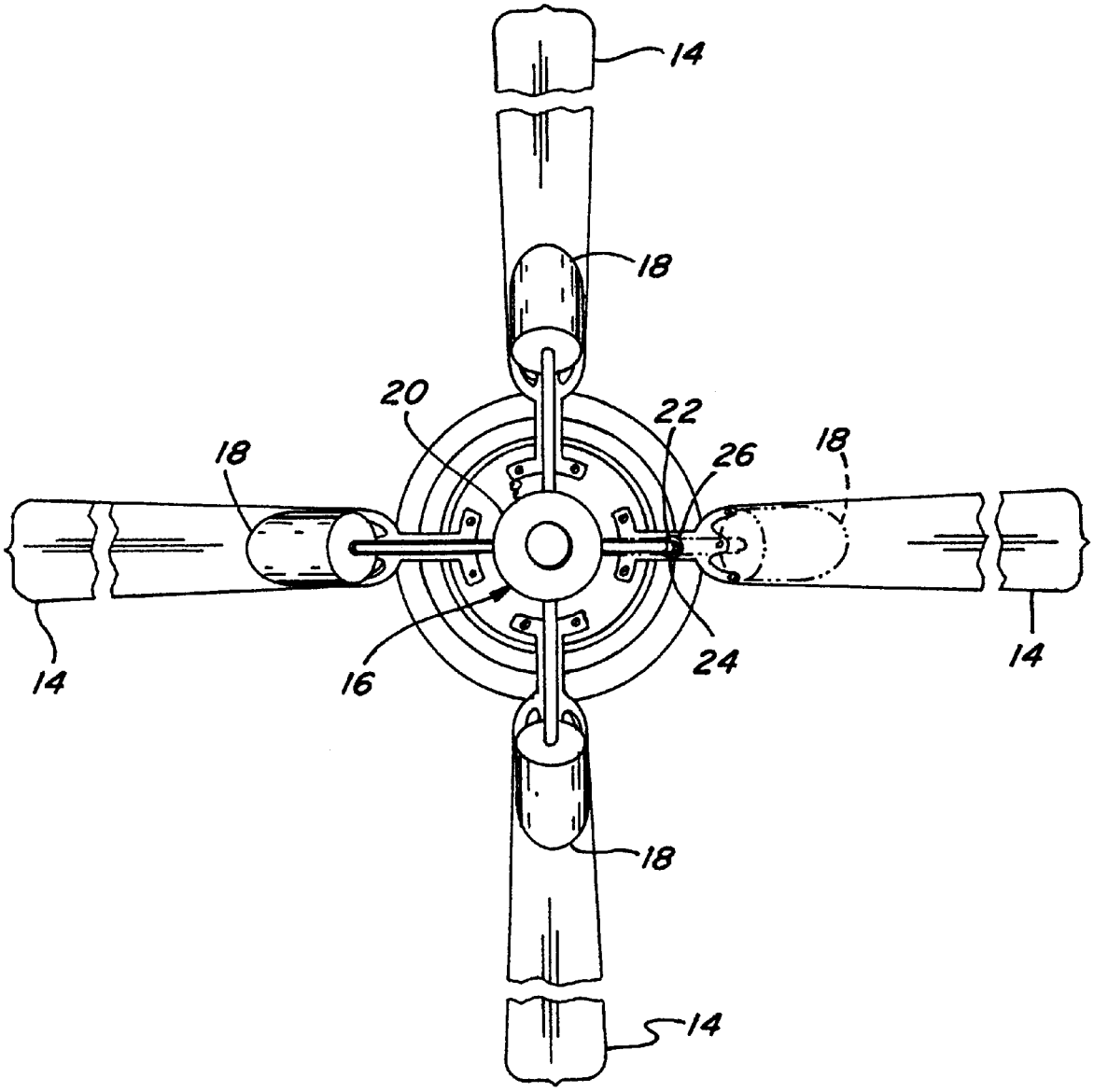
FIG. 2 is a bottom view of the ceiling fan construction of FIG. 1.

Referring to the drawings more particularly by reference numbers, wherein like numerals refer to like parts, FIGS. 1 and 2 illustrate a fan blade illumination apparatus 10 constructed in accordance with the teachings of one embodiment of the present invention. The apparatus 10 includes a ceiling fan 12 which fan may be an ordinary ceiling fan having one or more fan blades 14. Indicia may be imprinted directly upon the lower surface of one or more of the fan blades 14 or such indicia may be imprinted onto a wide variety of different types of fan blade covers which are selectively and removably positionable over each respective blade 14. The use of fan blade covers can be advantageous in that the indicia to be advertised through the present illumination apparatus can be repeatedly changed to promote different products and services thereby offering the user greater flexibility in its advertising and marketing campaigns.

As best illustrated in FIG. 1, fixedly connected to fan 12 and extending downwardly therefrom is an illuminating unit 16 having a central body portion 20 and one or more strobe light units 18 attached thereto. Strobe light units 18 are preferably positioned at substantially equal, spaced apart, intervals around the central body portion 20 as shown in FIGS. 1 and 2, each strobe light unit 18 being preferably angularly positioned upwardly to project light emitted therefrom directly upon the fan blades 14. The illumination unit 16 preferably has at least as many strobe light units 18 as fan blades 14, although it is recognized that a single strobe light unit or any plurality can be used depending upon the particular application and the visual effect so desired.

In a preferred embodiment, the illumination unit 16 also includes some type of means for detecting the operation of the fan 12, namely, the rotational speed of the fan blades 14. This means may include an electric-eye emitter 22 and an electric-eye sensor 24 fixedly connected to the central body portion 20 as illustrated in FIG. 1. A reflector 26 positioned on a particular fan blade 14 in registration and/or alignment with emitter 22 and sensor 24 will reflect a beam of light emitted by emitter 22 substantially towards sensor 24 thereby triggering sensor 24 when that particular fan blade is in a particular angular position. When fan 12 is operational, reflector 26 will trigger sensor 24 once, and only once, during each revolution of the fan blades 14. Accordingly, the rotational speed of the fan can be easily determined since the number of times sensor 24 is triggered in a given time interval will yield the speed of fan.

Preferably, an electronic control module (ECM) or other processor or controller means 28 positioned in or otherwise associated with central body portion 20 is coupled to sensor 24 and continuously performs the desired calculations to determine the speed of fan 12. Electronic controllers or modules such as controller 28 are commonly used in association with apparatus for controlling and accomplishing various tasks including monitoring and controlling a wide variety of electro-mechanical functions similar to those disclosed in the present application. Such controllers are typically utilized for delivering current control signals to devices such as lights and motors for controlling the performance thereof. Those skilled in the art are familiar with implementing programs and methods in electronic control modules such as controller 28 to accomplish particular tasks such as those discussed herein. In this regard, controller 28 may include processing means such as a microcontroller or microprocessor, associated electronic circuitry such as input/output circuitry, analog circuits or programmed logic arrays, as well as associated memory. Controller or ECM 28 can therefore be programmed to sense and recognize a signal from sensor 24 indicative of one complete 360° rotation of fan 12 and, based upon such sensed number of rotations in a predetermined time interval, controller or ECM 28 can easily and quickly determine the speed of fan 12.

Based upon the calculated speed of fan 12, controller 28 can control and synchronize the operation of the strobe lights 18 based upon the rotational speed of fan blades 14. Preferably, strobe light units 18 are coupled directly to controller 28 for controlling the operation thereof, however, it is likewise recognized and anticipated that controller 28 can also generate an appropriate signal whereby the operation of strobe light units 18 may be controlled in any one of numerous other ways known in the art such as by microcontrollers, transformers, logic arrays, electronic switching devices, motors, and so forth. In one embodiment, each strobe light 18 is programmed to flash once during every complete rotation of fan 12 when a corresponding fan blade 14 is in the same particular angular orientation relative to a particular strobe light unit 18. Each strobe light unit 18 associated with fan 12 will be associated with a different fan blade 14 such that the repetitious illumination of each fan blade 14 in the same angular position during each revolution of the blade results in the illusion of the fan blades 14 being statically still whereby indicia imprinted thereon is clearly visible in the same spot by virtue of the light projected thereupon by strobe light units 18. Thus, despite the angular velocity of fan blades 14, the indicia thereupon appears static to the human eye in a particular angular position of the fan, and is conveniently observable without distortion. Further, one skilled in the art will appreciate that the period of each strobe flash from strobe lights 18 must be controlled in accordance with the angular velocity of fan 12. The faster fan 12 rotates, the shorter the duration of the flash must be, and vice versa. Furthermore, it is preferable that the angular velocity of fan 12 be as high as possible because a higher fan speed will translate into a higher frequency of flashing of the respective strobe light units 18 onto the respective fan blades 14 thereby resulting in better illumination of the indicia imprinted thereon and the appearance of a continuous illumination thereof to the human eye.

Although it is preferred that the number of strobe lights 18 be equal to the number of fan blades 14 whereby each fan blade 14 may be illuminated at mutually exclusive angular position during each rotation of fan 12, it is also recognized that any number of strobe light units 18 may be utilized including the use of only one strobe light unit 18 without departing from the spirit and scope of the present invention. Particularly in an embodiment of the present invention wherein illumination results in a flow pattern, as discussed below, one strobe light unit 18 may suffice irrespective of the number of fan blades 14.

In another embodiment of the present invention, indicia imprinted onto or otherwise associated with the fan blades 14 may collectively form a so-called flow pattern. In a flow pattern, the indicia on each fan blade differs slightly, and proper sequential flashing thereof results in an illusion of an animated sequence similar to the concepts utilized in projecting cinema film or in the creation of animated cartoons. To accomplish a flow pattern illusion, the strobe flashing of each fan blade 14 is done sequentially, that is, one fan blade 14 is flashed in one rotation of fan 12, another fan blade 14 is flashed in the next rotation of fan 12, and so on, wherein all fan blades 14 are flashed in substantially the same position by the same strobe light 18. This results in an animated image at a particular angular position of the fan, which sequence may be repeated as many times as desired at scheduled time intervals if desired, and the synchronized flashing of the strobe light unit 18 may be programmed into the controller 28. One skilled in the art will readily appreciate that the greater the number of fan blades 14, the greater the length and resolution of the flow pattern. It is also recognized and anticipated that illumination of a flow pattern my likewise be achieved by using a plurality of strobe lights 18 and that more than one fan blade may be illuminated on any particular revolution of the fan 12.

Figure 3:
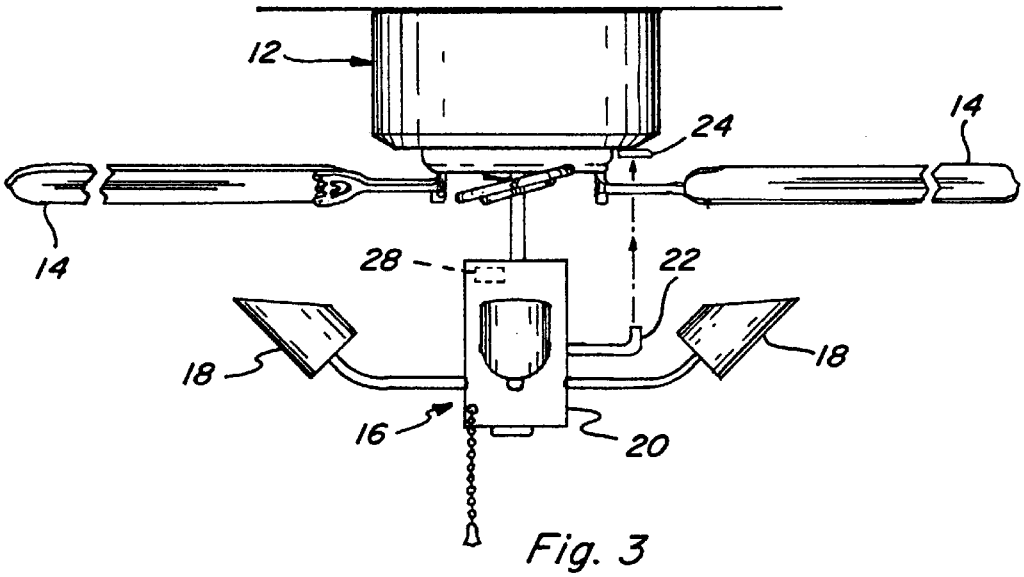
FIG. 3 is a side elevational view of another embodiment of the present invention.

It is contemplated and anticipated that various other arrangements and embodiments of the electric-eye emitter 22 and sensor 24 are likewise possible. For example, as illustrated in FIG. 3, sensor 24 may be positioned on the fan 12 so as to be located behind the fan blades 14 in line with the beam of light emitted by emitter 22, and reflector 26 may be eliminated from the apparatus. In such an arrangement, the constant beam of light between emitter 22 and sensor 24 will be interrupted each time a fan blade 14 passes therebetween, each fan blade thereby triggering sensor 24 when the fan 12 is in operation. The speed of fan 12 may then be determined by controller 28 as similarly discussed above taking into account the total number of fan blades 14 associated with fan 12.

In yet another embodiment, reflector 26 may be positioned on the fan 12 so as to be located behind fan blades 14 at an appropriate location and/or angular orientation, and the emitter 22 and sensor 24 may be positioned slightly offset from each other so as to produce two separate light beams, one beam emitted from emitter 22 to reflector 26, and, because of the angular orientation of reflector 26, a second beam extending from reflector 26 to sensor 24. As a result, the emitted light beam from emitter 22 is interrupted twice by each fan blade 14, and the distance and time interval between each pair of interruptions will yield the instantaneous angular velocity of fan 12. Alternatively, other types of sensors may be utilized such as a magnetic sensor or a Halifax emitter, which sensors can trigger an appropriate signal to controller 28 in response to the rotation speed of fan 12. Accordingly, numerous such implementations are possible, and all such implementations are considered equivalent to the disclosure herein.

In still another embodiment of the present invention, the determination of the speed of fan 12 may not be necessary. In this regard, the strobe lights 18 may be implemented to flash directly due to the triggering of sensor 24. In the embodiment disclosed in FIG. 1 wherein the reflector 26 is associated with a particular fan blade 14, this would result in the desired flashing of the strobe light units 18 when fan 12 is in the precise same angular position each time. In the embodiment illustrated in FIG. 3, the actuation of the strobe lights 18 could be sequenced to a set of multiple activations of the sensor 24 such as every two or every four triggerings of the sensor 24. Other combinations are likewise possible. Thus the overall design of the present invention may be simplified.

It is also contemplated and anticipated that other types of strobe flashing sequences will produce a variety of predetermined visual effects. For example, if the number of strobe light units 18 is twice the number of fan blades 14, the indicia imprinted on each fan blade 14 may be strobed twice at mutually exclusive angular positions, and would therefore appear statically frozen to the human eye at two different locations. This would result in twice the number of frozen images as the number of fan blades 14. Alternatively, in an embodiment where illumination of the fan blades results in a flow pattern, the flow pattern may appear animated in two different locations simultaneously if there are twice the number of strobe light units 18 as compared to the number of fan blades 14. Similarly, utilizing three times the number of strobe light units 18 as compared to the number of fan blades 14 can result in the illustration of three times the number of static images, and so forth. Such variations are contemplated and anticipated, and all such variations are considered equivalent to the disclosure herein.

As is evident from the foregoing description, certain aspects of the present invention are not limited to the particular details of the examples illustrated herein, and it is therefore contemplated that other modifications and applications will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

What is claimed is:

1. Apparatus associated with a fan for illuminating indicia associated with at least one fan blade, the apparatus comprising:

at least one strobe light unit associated with the fan, said strobe light unit being positioned and located so as to direct light onto the at least one fan blade at a particular location during the rotational motion of the fan blade;

an emitter associated with the fan, said emitter being operable to emit a signal therefrom;

a sensor positioned to sense the rotational motion of said at least one fan blade based upon the signal emitted by said emitter; and a controller coupled to said sensor and to said at least one strobe light unit, said controller being operable to control the operation of said at least one strobe light unit based upon signals received from said sensor, said at least one strobe light unit being synchronized with the rotation of the at least one fan blade such that indicia associated with the at least one fan blade appears to be statically still at a particular location during the rotational motion of the at least one fan blade.

2. The apparatus as set forth in claim 1 wherein the fan includes a plurality of fan blades and said apparatus includes a plurality of strobe light units, each of said fan blades having indicia associated therewith, said controller being coupled to each of said plurality of strobe light units to control the operation thereof based upon the signals received from said sensor, said plurality of strobe light units being synchronized with the rotation of said plurality of fan blades such that indicia associated with said plurality of fan blades appears to be statically still at particular locations during the rotation of said plurality of fan blades.

3. The apparatus as set forth in claim 1 wherein said controller determines the rotational speed of the fan based upon the signals received from said sensor, said controller controlling the flashing of said at least one strobe light based upon said determined fan speed.

4. The apparatus as set forth in claim 1 wherein said controller is operable to control the operation of said at least one strobe light unit in direct response to an interruption of the signal emitted by said emitter.

5. The apparatus as set forth in claim 1 including a reflector member positioned on the at least one fan blade, said reflector member reflecting the signal emitted by said emitter towards said sensor for reception thereby during each revolution of the at least one fan blade.

6. The apparatus as set forth in claim 1 wherein the fan includes a plurality of fan blades, each of said fan blades having indicia associated therewith, and wherein the operation of said at least one strobe light unit creates a flow pattern appearing as an animated sequence at a particular location during the rotation of said fan blades.

7. The apparatus as set forth in claim 1 wherein the indicia associated with the at least one fan blade is imprinted directly onto the at least one fan blade.

8. The apparatus as set forth in claim 1 wherein the indicia associated with the at least one fan blade is imprinted onto a fan blade cover which at least partially covers the at least one fan blade.

9. Apparatus associated with a fan for illuminating indicia associated with at least one fan blade, the apparatus comprising:

at least one strobe light unit associated with the fan, said strobe light unit being positioned and located so as to direct light onto the at least one fan blade at a particular orientation during the rotational motion of the fan blade;

an emitter associated with the fan, said emitter being operable to emit a signal therefrom;

a sensor positioned in cooperation with said emitter to sense the rotational motion of the at least one fan blade based upon the signal emitted by said emitter; and a controller coupled to said sensor for receiving signals therefrom, said controller being operable to determine the rotational speed of the fan based upon the signals received from said sensor;

said controller being further coupled to said at least one strobe light unit, said controller being operable to control the operation of said at least one strobe light unit based upon the rotational speed of the fan, said at least one strobe light unit being synchronized with the speed of the fan such that indicia associated with the at least one fan blade appears to be statically still at a particular orientation during the rotational motion of the at least one fan blade.

10. The apparatus as set forth in claim 9 wherein said controller determines the speed of the fan based upon a number of interruptions of the signal emitted by said emitter and received by said sensor during a predetermined time interval.

11. Apparatus associated with a fan for illuminating indicia associated with at least one fan blade, the apparatus comprising:

at least one strobe light unit associated with the fan, said strobe light unit being positioned and located so as to direct light onto the at least one fan blade at a particular location during the rotational motion of the fan blade;

an emitter associated with the fan operable to emit a signal therefrom;

a sensor positioned to sense the signal emitted by said emitter; and a controller coupled to said sensor and to said at least one strobe light unit, said controller being operable to control the operation of said at least one strobe light unit based upon an interruption of the signal emitted by said emitter and sensed by said sensor, said at least one strobe light unit being synchronized with the rotation of the at least one fan blade such that the indicia associated with the at least one fan blade appears to be statically still at a particular location during the rotational motion of the at least one fan blade.

12. Apparatus associated with the fan for illuminating indicia associated with at least one fan blade, the apparatus comprising:

at least one strobe light unit associated with the fan, said strobe light unit being positioned and located so as to direct light onto the at least one fan blade at a particular location during the rotational motion of the fan blade;

an emitter associated with the fan, said emitter being operable to emit a signal therefrom; and a sensor positioned to sense the signal emitted by said emitter, said sensor being coupled to said at least one strobe light unit and being operable to control the operation thereof based upon the interruption of the signal emitted by said emitter, said at least one strobe light unit being synchronized with the rotation of the at least one fan blade such that indicia associated with the at least one fan blade appears to be statically still at a particular location during the rotational motion of the at least one fan blade.

* * * * *